US007331814B2

(12) United States Patent
Pratt

(10) Patent No.: US 7,331,814 B2
(45) Date of Patent: Feb. 19, 2008

(54) APPARATUS CONFIGURED TO ATTACH TO AN ELECTRICAL CONNECTOR BLOCK

(75) Inventor: Jerome A. Pratt, Georgetown, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 75 days.

(21) Appl. No.: 11/170,956

(22) Filed: Jun. 30, 2005

(65) Prior Publication Data

US 2007/0004272 A1 Jan. 4, 2007

(51) Int. Cl.
*H01R 4/24* (2006.01)

(52) U.S. Cl. ..... 439/409; 439/417

(58) Field of Classification Search ..... 439/409, 439/417

See application file for complete search history.

(56) References Cited

U.S. PATENT DOCUMENTS

| | | | |
|---|---|---|---|
| 3,067,403 | A | 12/1962 | Kulka |
| 4,227,762 | A | 10/1980 | Scheiner |
| 4,508,411 | A | 4/1985 | Hughes et al. |
| 4,541,679 | A | 9/1985 | Fiedler et al. |
| 4,795,363 | A | 1/1989 | Scherer et al. |
| 4,815,988 | A | 3/1989 | Scherer |
| 4,820,193 | A | 4/1989 | Noorily |
| 4,932,894 | A | 6/1990 | Scherer |
| 4,995,829 | A | 2/1991 | Geib et al. |
| 5,080,607 | A | 1/1992 | Cristescu |
| 5,178,558 | A | 1/1993 | Knox et al. |
| 5,281,163 | A | 1/1994 | Knox et al. |
| 5,435,747 | A | 7/1995 | Franckx et al. |
| 5,503,572 | A | 4/1996 | White et al. |
| 5,504,654 | A | 4/1996 | Knox et al. |
| 5,529,513 | A | 6/1996 | Lee |
| 5,538,438 | A | 7/1996 | Orlando |
| RE35,325 | E | 9/1996 | Wass et al. |
| 5,695,361 | A | 12/1997 | Elisei |
| 5,741,153 | A | 4/1998 | Schwer |
| 5,762,518 | A | 6/1998 | Tanigawa et al. |
| 5,785,548 | A | 7/1998 | Capper et al. |

(Continued)

FOREIGN PATENT DOCUMENTS

| | | |
|---|---|---|
| DE | 31 45 483 A1 | 5/1983 |

(Continued)

OTHER PUBLICATIONS

U.S. Appl. No. 10/941,441; Xavier Fasce et al, filed Sep. 15, 2004, entitled "Connector Assembly for Housing Insulation Displacement Elements".

(Continued)

*Primary Examiner*—Tho D. Ta
(74) *Attorney, Agent, or Firm*—Janet A. Kling; John A. Burtis

(57) ABSTRACT

An apparatus is configured to releasably attach to an access cover of an insulation displacement connector block. The apparatus is adapted to engage with the insulation displacement connector block to form at least a part of a securing mechanism for securing the access cover in a first closed position. The apparatus may be disengaged from the insulation displacement connector block to move the access cover from the first closed position to a second open position.

21 Claims, 2 Drawing Sheets

U.S. PATENT DOCUMENTS

| | | | | |
|---|---|---|---|---|
| 5,797,759 | A | 8/1998 | Mattis et al. | |
| 5,836,791 | A | 11/1998 | Waas et al. | |
| 5,971,795 | A * | 10/1999 | Daoud et al. | 439/409 |
| 6,015,312 | A | 1/2000 | Escane | |
| 6,099,343 | A | 8/2000 | Bonvallat et al. | |
| 6,102,731 | A * | 8/2000 | Daoud | 439/409 |
| 6,152,760 | A | 11/2000 | Reeser | |
| 6,159,036 | A | 12/2000 | Daoud | |
| 6,188,560 | B1 | 2/2001 | Waas | |
| 6,193,556 | B1 | 2/2001 | Escane | |
| 6,222,717 | B1 | 4/2001 | Waas et al. | |
| 6,254,420 | B1 | 7/2001 | Letailleur et al. | |
| 6,254,421 | B1 | 7/2001 | Denovich et al. | |
| 6,283,785 | B1 * | 9/2001 | Daoud | 439/409 |
| 6,371,794 | B1 | 4/2002 | Bauer et al. | |
| 6,406,324 | B1 | 6/2002 | Duesterhoeft et al. | |
| 6,421,941 | B1 | 7/2002 | Finke et al. | |
| 6,672,895 | B2 * | 1/2004 | Scheiner | 439/491 |
| 6,811,430 | B1 | 11/2004 | Carrico et al. | |
| 6,893,280 | B2 | 5/2005 | Thompson et al. | |
| 2003/0049961 | A1 | 3/2003 | Tricaud et al. | |

FOREIGN PATENT DOCUMENTS

| | | | |
|---|---|---|---|
| EP | 0 271 413 | | 6/1988 |
| EP | 0 708 497 | A2 | 4/1996 |
| EP | 1 069 578 | A1 | 1/2001 |
| EP | 1 130 685 | A2 | 9/2001 |
| FR | 2 730 096 | | 8/1996 |
| GB | 2 129 628 | | 5/1984 |
| GB | 2 149 231 | | 6/1985 |
| WO | WO 97/20367 | | 6/1997 |
| WO | WO 99/04454 | | 1/1999 |
| WO | WO 99/04455 | | 1/1999 |

OTHER PUBLICATIONS

U.S. Appl. No. 10/941,506; Xavier Fasce et al, filed Sep. 15, 2004, entitled "Insulation Displacement System for Two Electrical Conductors".

U.S. Appl. No. 29/213,197; Xavier Fasce et al, filed Sep. 15, 2004, entitled "Cap for Electrical Connector".

U.S. Appl. No. 11/131,639, Dower et al, filed May 18, 2005,entitled Electrical Connector Assembly and Method of Forming the Same.

U.S. Appl. No. 11/131,874, Hills et al, filed May 18, 2005, entitled "Frame Assembly".

* cited by examiner

APPARATUS CONFIGURED TO ATTACH TO AN ELECTRICAL CONNECTOR BLOCK

FIELD

The present invention relates to an apparatus for use in connection with an insulation displacement connector block ("connector block"). More particularly, the present invention relates to an apparatus that is configured to releasably attach to an access cover of a connector block, where the apparatus includes at least a part of a releasable securing mechanism to secure the access cover in a closed position.

BACKGROUND

In a telecommunications context, connector blocks are connected to cables that feed subscribers while other connector blocks are connected to cables that are fed from a service provider center. To make the electrical connection between the subscriber block and the service provider block, an electrical conductor (e.g., a jumper wire) may be inserted in each connector block to complete the electrical circuit. Typically an electrical conductor ("conductor") can be connected, disconnected, and reconnected several times as the subscriber's needs change.

The basic components of a connector block typically include a plurality of housing assemblies, where each housing assembly includes a housing, an insulation displacement connector (IDC) element disposed within the housing, and an access cover connected to the housing. The IDC element is used to make an electrical connection with a conductor that is partially disposed within the housing in order to complete the electrical circuit between the subscriber block and service provider block. The IDC element displaces the insulation from a portion of the conductor when the conductor is inserted into a slot within the IDC element. An electrical contact is then made between the conductive surface of the IDC element and the conductive core of the electrical conductor.

The access cover is moveable between an open position and a closed position. In one type of connector block ("Type A"), a conductor is fed into an opening in an access cover, and as the access cover is moved from its open position to its closed position, the conductor moves into the respective housing and contacts the IDC element disposed in the housing. After electrical contact is made between the conductor and IDC element and the access cover is in a closed position, the conductor extends from the access cover. In a Type A connector block, a portion of the conductor disposed within the access cover moves therewith. If the access cover is opened, the electrical connection between the conductor and the IDC element will likely be disrupted because the conductor moves with the access cover and as a result, may no longer be in contact with the IDC element. A disrupted electrical connection between the IDC element and the conductor results in a disrupted electrical circuit (between the service provider and the subscriber), and therefore disrupted service for the subscriber.

In another type of connector block ("Type B"), a conductor is initially fed into an opening in the housing and then into an opening (or "recess") in an access cover (when the access cover is in its open position). As the access cover moves from its open position to its closed position, the portion of the conductor moving through the opening in the access cover is severed from the main part of the conductor. As a result, the conductor is no longer disposed within the opening in the access cover. After the access cover is in its closed position, the conductor contacts the IDC element disposed within the respective housing of the access cover and an electrical connection is made between the conductor and the IDC element. The conductor extends from the opening in the housing rather than the access cover, as in a Type A connector block. Because the conductor is no longer disposed with the access cover in a Type B connector block, the conductor will likely remain in contact with the IDC element if the access cover is moved into its open position after the electrical connection is made.

In both types of connector blocks, the IDC element disposed within the housing of the connector block is accessible when the access cover is in its open position. When the access cover is in its open position, the IDC element may be exposed to environmental hazards, such as moisture. It is typically preferred that the access cover remain in a closed position after an electrical connection is made between the conductor and IDC element in order to protect the electrical connection from environmental hazards. Of course, the access cover may be opened for maintenance purposes. As demonstrated by the Type A connector block, it may also important that the access cover of each housing assembly of a connector block remain in a closed position after an electrical connection between a conductor and IDC element in order to help prevent the circuit from becoming disrupted.

A securing mechanism, such as a latching mechanism, is typically used to fix the access cover in a closed position. However, in some existing connector blocks, if the securing mechanism is damaged, it may be desirable to replace the entire access cover, or the entire housing assembly may be unusable because the access cover will not be able to maintain its closed position. In some connector block designs, it may be difficult to replace the access cover.

When a connector block is used in the telecommunications context, a plurality of connector blocks are typically mounted in a central location, such as a telecommunications closet, an outdoor cabinet, an aerial terminal or closure, or other common use applications. Oftentimes, thousands of electrical circuits between the subscribers and service provider are completed in the central location. It may be important to mark a circuit, or a series of circuits, to distinguish the circuit from other circuits in the central location. For example, it may be important to mark circuits providing telecommunications services to a hospital or police station so that those circuits are easily identifiable.

BRIEF SUMMARY

In a first aspect, the present invention is an apparatus configured to attach to an access cover of an insulation displacement connector block, the access cover being moveable between a first position and a second position. The apparatus comprises a body adapted to attach to the access cover, and an appendage extending from the body. At least a portion of the appendage is adapted to engage with the insulation displacement connector block to form at least a part of a securing mechanism for securing the access cover in the first position, where the portion of the appendage may be disengaged from the insulation displacement connector block to allow movement of the access cover from the first position to the second position.

In a second aspect, the present invention is an electrical connector assembly comprising a housing, an access cover connected to the housing, and an apparatus releasably attached to the access cover. The housing includes an insulation displacement connector element, which is adapted to electrically connect with a conductor partially disposed within the housing. The access cover is moveable between a closed position and an open position, where in the open position, the insulation displacement connector disposed within the housing is accessible. At least a portion of the apparatus is adapted to engage with the housing to form at least a part of a securing mechanism for securing the access cover in the closed position, where the portion of the apparatus may be disengaged from the housing to allow movement of the access cover from the first position to the second position.

The above summary is not intended to describe each disclosed embodiment or every implementation of the present invention. The figures and the detailed description which follow more particularly exemplify illustrative embodiments.

BRIEF DESCRIPTION OF THE DRAWINGS

The present invention will be further explained with reference to the drawing figures listed below, where like structure is referenced by like numerals throughout the several views.

While the above-identified figures set forth an exemplary embodiment of the present invention, other embodiments are also within the invention. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

The present invention is an apparatus configured to attach to an access cover of a connector block. The apparatus may also be called a cap. The cap may serve at least two purposes. First, the cap may form at least a part of a releasable securing mechanism for securing the access cover in a first position (e.g., a closed position), where the securing mechanism may be released to move the access cover between the first position and a second position (e.g., an open position). Second, the cap may be color-coded to distinguish the circuit associated with the cap from other circuits.

A cap in accordance with the present invention may be formed of any suitable materials, including, but not limited to, polycarbonate, polypropylene, polyester, or polyethylene. The cap is configured to releasably attach to at least one access cover of a connector block. The connector block typically includes a plurality of housing assemblies, where each housing assembly includes a housing, an IDC element disposed within the housing, and an access cover connected to the housing. Each IDC element in each housing assembly is used to complete at least one circuit between a subscriber cable and service provider cable. As a result, one access cover corresponds to at least one circuit.

An access cover typically includes a releasable securing mechanism, such as a latching mechanism, to secure the access cover in a closed position. The releasable feature of the securing mechanism allows the access cover to be released from its secured, closed position so that it may be moved into an open position. For example, a latching mechanism may have a latching member and a release member. The latching member may fit within an opening (i.e., engage with the opening) in the housing to secure the access cover in a closed position. In this configuration, the latching member is in a "latched position". However, if desired, the release member can be moved away from the opening in the housing to release the latching member from its latched position, thereby allowing the access cover to be moved into an open position.

Figure 3:
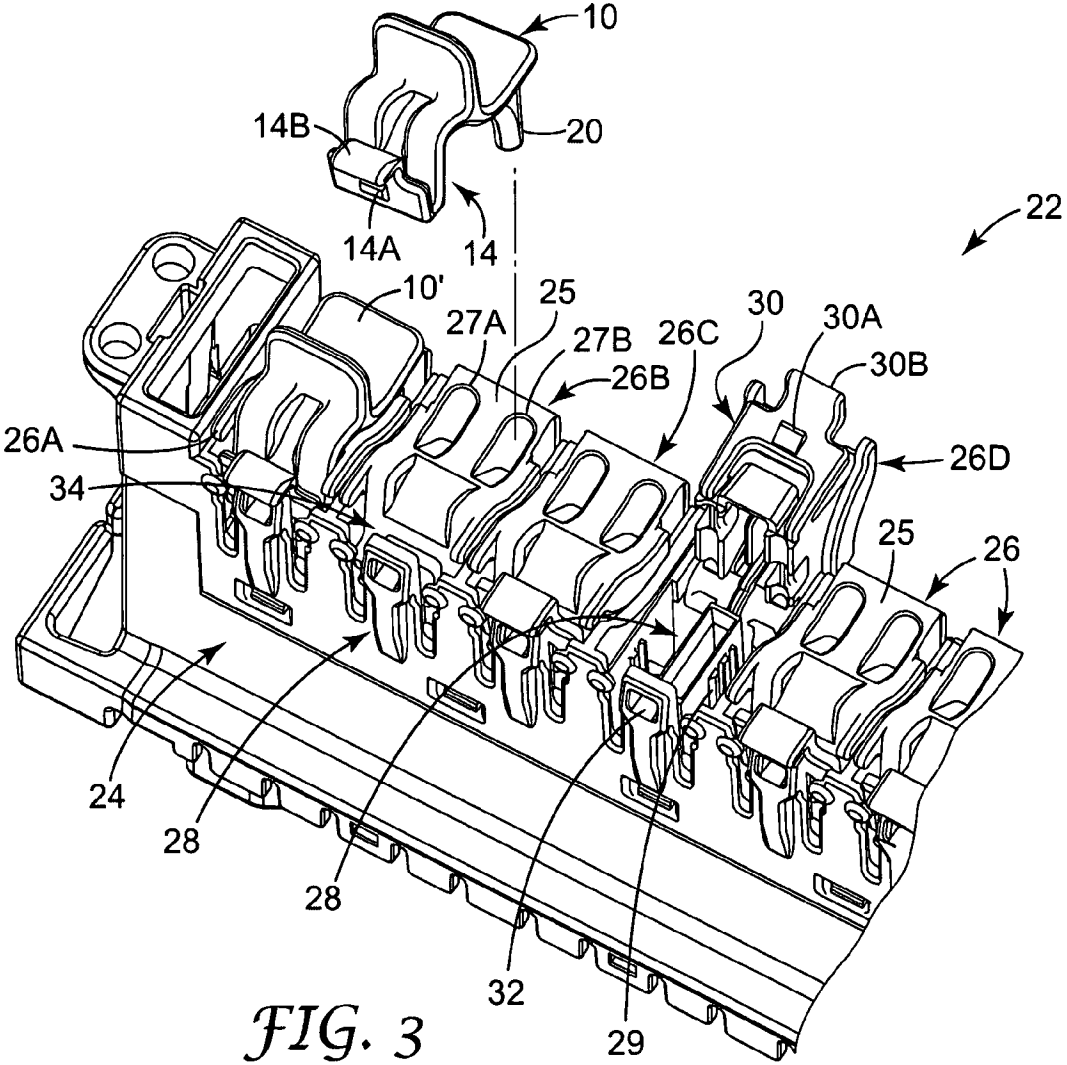
FIG. 3 is a partial exploded perspective view of an electrical connector assembly of the present invention, which includes an electrical connector block including a plurality of access covers, and two inventive apparatuses, where one apparatus 10' is attached to an access cover, and another apparatus 10 is aligned to attach to an adjacent access cover.

In a telecommunications context, a connector block, such as connector block 24 of FIG. 3, is typically mounted alongside a plurality of other connector blocks in a central location. After the connector block is mounted in the central location, at least a part of the access cover may become damaged, either from wear and tear, from being broken off, or otherwise. It may be troublesome if the securing mechanism of the access cover becomes damaged (i.e., dysfunctional) because it may affect the ability of the access cover to remain in a closed position. As stated in the Background section, it may be desirable for an access cover to remain in a closed position after a conductor is electrically connected to the IDC element in the respective housing of the access cover. The closed position helps to ensure the conductor remains in electrical contact with the IDC element and/or helps prevent environmental hazards from being introduced into the housing of the connector block.

The present invention provides an efficient alternative to replacing an entire access cover if the securing mechanism of the access cover is damaged. Rather than replacing the damaged access cover or not utilizing a housing assembly because of a damaged access cover, a cap of the present invention may be releasably attached to the access cover to render the access cover (and therefore, the housing assembly) in condition for usability. A cap of the present invention may replace all or part of a damaged releasable securing mechanism.

In an exemplary embodiment of the present invention, the cap may be used to replace the latching and release members of a latching mechanism. The exemplary cap includes a portion that is substantially similar in structure to the portion of the access cover that has been damaged and/or removed. When the cap is attached to an access cover, at least part of the cap is in close conforming contact with at least part of the top surface of the access cover. Also in the exemplary embodiment, the cap attaches to the access cover without the use of any further attaching means, such as an adhesive. In alternate embodiments, further attaching means may be used to attach the cap to the access cover.

Figure 1:
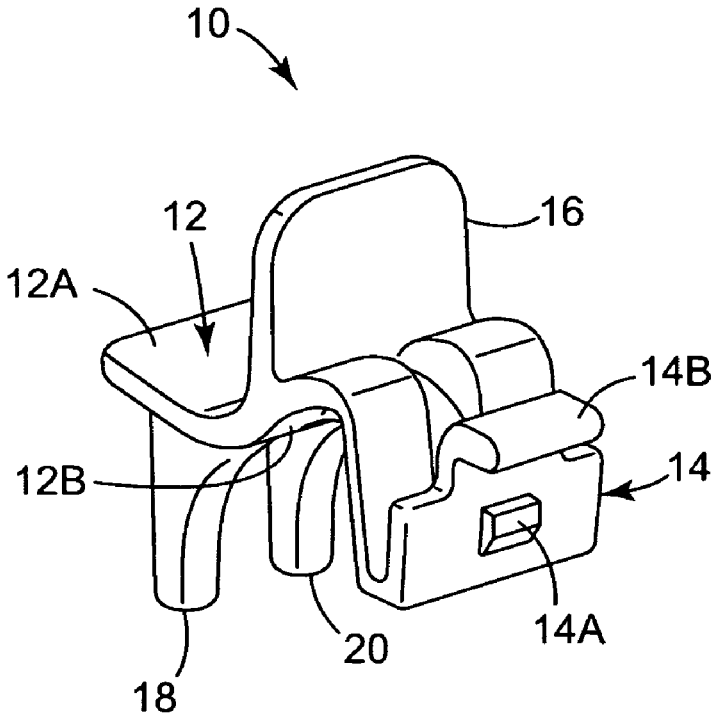
FIG. 1 is a perspective view of an exemplary embodiment of an apparatus of the present invention, where the apparatus includes a body and an appendage extending from the body.

FIG. 1 shows a perspective view of an exemplary embodiment of cap 10, which includes body 12, appendage 14, gripping tab 16, and locating pins 18 and 20. In the exemplary embodiment, cap 10 is a unitary apparatus, where the body 12, appendage 14, gripping tab 16, and locating pins 18 and 20 are formed from a single piece of material. Body 12 includes first surface 12A and second surface 12B, where first and second surfaces 12A and 12B, respectively, are located on opposite sides of body 12. As seen in FIG. 3, in the exemplary embodiment, at least a part of second surface 12B is in close conforming contact with a top surface 25 of an access cover 26 of an electrical connector block 24 when cap 10 is attached to the connector block 24.

Appendage 14 includes latching member 14A and release member 14B. Latching member 14A is configured (or "adapted") to engage with a surface within an opening (e.g., opening 32 shown in FIG. 3) of a housing (e.g., housing 28 shown in FIG. 3), and therefore be "received" in the opening. Latching member 14A is in a latched position when it is received in the opening of the housing, and when latching member 14A is in the latched position, the access cover is fixed in a closed position. This is further illustrated and described in reference to FIG. 3.

Gripping tab 16 extends from first surface 12A of body 12, and may be used by a telecommunications worker to both attach cap 10 to an access cover and remove cap 10 from the access cover. Specifically, the telecommunications worker may grasp gripping tab 16 with his fingers or a tool, such as pliers.

Locating pins 18 and 20 extend from second surface 12B of body 12, and are used to align cap 10 with an access cover. In this way, cap 10 is "self-aligning". In the exemplary embodiment, locating pins 18 and 20 are received in recesses (e.g., recesses 27A and 27B, respectively, shown in FIG. 3) in the access cover, thereby aligning cap 10 with the access cover. Although two locating pins 18 and 20 are shown in FIG. 1, a cap of the present invention may have any suitable number of locating pins 18 and 20. In alternate embodiments, other suitable means of locating a cap with respect to the access cover are used. In yet other alternate embodiments, a cap is not self-aligning and is aligned by a telecommunications worker.

Figure 2:
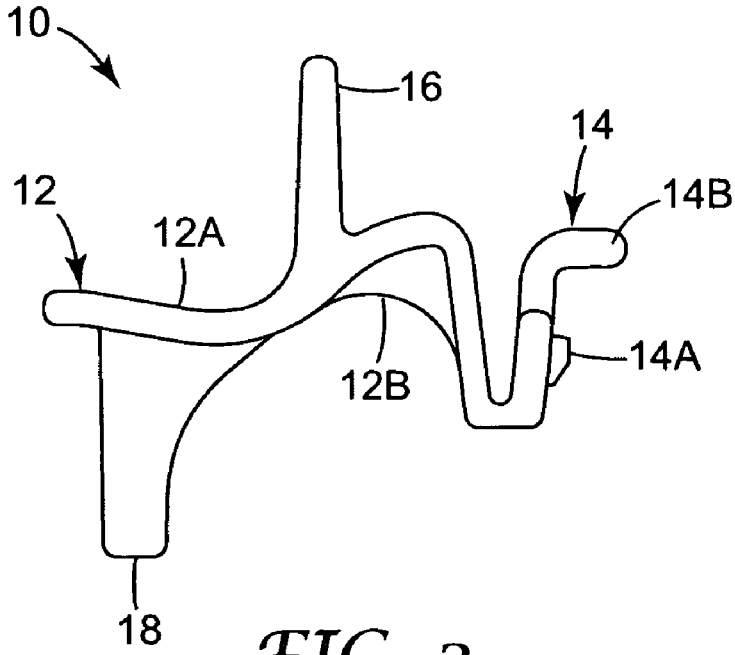
FIG. 2 is a side view of the apparatus of FIG. 1.

FIG. 2 is a side view of cap 10 of FIG. 1 and illustrates the contour of second surface 12B of body 12. Second surface 12B is configured so that at least part of second surface 12B is in close conforming contact with a top surface 25 of the access cover 26 (shown in FIG. 3) when cap 10 is attached to the access cover 26. Specifically, in the exemplary embodiment, second surface 12B has a similar contour to the top surface 25 of the access cover 26.

FIG. 3 is a partially exploded assembly view of electrical connector assembly 22 of the present invention, where electrical connector assembly 22 includes caps 10 and 10' and connector block 24. Exemplary connector block 24 is a Type B connector block (as described in the Background section), and includes access covers 26 (including access covers 26A, 26B, 26C, and 26D), which are each substantially similar in structure and are each moveable between an open position (e.g., access cover 26D) and a closed position (e.g., access cover 26C). In the illustrated embodiment, each access cover 26 includes two recesses (e.g., recesses 27A and 27B of access cover 26B) for receiving a conductor and a latching mechanism (e.g., latching mechanism 30 of access cover 26D), which will be discussed in detail below.

An access cover 26 is connected to a housing 28, and together each access cover 26 and its respective housing 28 form a housing assembly. An IDC element 29 is disposed within each housing 28. Each IDC element 29 is adapted to electrically connect with a conductor that is introduced into the respective housing 28. The electrical connection between IDC element 29 and conductor completes an electrical circuit between a subscriber block and a service provider block. As FIG. 3 shows, each housing 28 and respective IDC element 29 is accessible when the access cover is in an open position (e.g., access cover 26D).

The description of the structure of access cover 26D is representative of each of the access covers 26. Access cover 26D includes latching mechanism 30 to secure access cover 26D in its closed position relative to housing 28. As described in the Background section, it is sometimes desirable to secure access cover 26D in its closed position. Latching mechanism 30 includes latching member 30A and release member 30B. Latching member 30A protrudes from access cover 26D and is configured to engage with a surface within opening 32 in housing 28 of connector block 24. Release member 30B is rigid, but flexible enough to be flexed away from opening 32 in order to disengage latching member 30A from the surface within opening 32. Disengaging latching member 30A from the surface within opening 32 enables access cover 26D to be moved from its closed position to its open position.

At some point during the lifespan of connector block 24, latching mechanism 30 may become dysfunctional. For example, latching member 30A may wear down over time after repeated opening and closing of access cover 26D. If latching member 30A wears down, it may not protrude sufficiently from access cover 26D to engage with the surface within opening 32 to secure access cover 26D in a closed position. Latching mechanism 30 may also become dysfunctional if releasing member 30B is separated from (i.e., broken off from) access cover 26D or if the entire latching mechanism 30 is separated from access cover 26D.

Rather than discontinuing use of the respective housing 28 or replacing access cover 26D or connector block 24 due to a damaged latching mechanism 30, cap 10 may be attached to access cover 26D to take the place and function of latching mechanism 30, just as it is attached to access cover 26A. As discussed in reference to FIG. 1, cap 10 includes a latching mechanism (appendage 14 with latching member 14A and release member 14B) that is configured to replace the damaged or missing latching mechanism 30 of access cover 26A (which has no latching mechanism 30). If just latching mechanism 30A becomes worn, latching mechanism 30 may be purposefully broken off to make room for cap 10 to attach to the access cover 26. In this way, a cap of the present invention may be used to replace a latching mechanism of an access cover. If an access cover includes a securing mechanism other than a latching mechanism, the concepts of the exemplary embodiment may be applied to form a cap that is configured to replace a part or all of such a securing mechanism.

FIG. 3 illustrates how cap 10 of FIG. 1 aligns with and attaches to access cover 26B of connector block 24. A latching mechanism 30 has been removed from access cover 26B, and so access cover 26B does not have a securing mechanism to secure access cover 26B in a closed position relative to its respective housing 28. After cap 10 is attached to access cover 26B, however, latching mechanism 14 of cap 10 may be used to secure access cover 26B in a closed position relative to housing 28. Cap 10 is configured to attach to access cover 26B and move with access cover 26B as it is opened and closed. The absence of latching mechanism 30 results in vacancy 34 between access cap 26B and housing 28 of connector block 24, and latching mechanism 14 of cap 10 is configured to fit within vacancy 34. Locating pin 18 (not shown in FIG. 3) of cap 10 is received in recess 27A and locating pin 20 of cap 10 is received in recess 27B. Locating pins 18 and 20 provide a means for aligning cap 10 with respect to access cover 26B, and also provide a means for fixing the position of cap 10 with respect to access cover 26B. That is, once locating pins 18 and 20 are received in recesses 27A and 27B, respectively, cap 10 will not be inclined to reorient itself with respect to access cover 26B. A contour of second surface 12B of cap 10 is similar to a contour of a top surface 25 of access cover 26B. Because of the similar contours, second surface 12B is in close conforming contact with access cover 26B when cap 10 is attached to access cover 26B.

In FIG. 3, cap 10' has already been attached to access cover 26A, and represents how cap 10 attaches to access cover 26B and can be used to latch access cover 26B in its closed position relative to its respective housing 28. With respect to access cover 26A, cap 10' replaces a latching member 30 of access cover 26A, which has been separated from access cover 26A. When access cover 26A is in a closed position, as shown in FIG. 3, latching member 14A of cap 10' engages with a surface within opening 32 and is resiliently biased against the surface by appendage 14 of cap 10'. This secures access cover 26A in a closed position. In order to move access cover 26A from its closed position to its open position, release member 14B is flexed away from opening 32 to disengage latching member 14A from the surface within opening 32. Access cover 26A may then be moved from its closed position (as shown in FIG. 3) to its open position (e.g., access cover 26D).

In another exemplary embodiment of the present invention, a cap, such as cap 10 shown in FIG. 1, is color-coded, for example, to distinguish a circuit that is associated with the particular access cover the cap is attached to from other circuits formed by connector blocks mounted in a central location. Typically, at least one circuit between a subscriber cable and service provider cable is completed in each housing assembly (i.e., housing 28 and access cover 26) of connector block 24. As a result, one access cover corresponds to at least one circuit. In a telecommunications context, a connector block, such as connector block 24 of FIG. 3, is typically mounted alongside a plurality of other connector blocks in a central location. Because a plurality of circuits are formed in the central location, it may be important to have a means for readily distinguishing some circuits from others.

A telecommunications worker is typically given access to the central location in order to connect and disconnect conductors completing the circuits between a subscriber cable and service provider cable. If the special circuits are marked, the telecommunications worker may be put on notice that those circuits are special. For example, a circuit that provides a police station or a hospital with telecommunications service may be designated as a special, higher priority circuit. The marking may also help organize the circuits completed in the central location, such as by grouping the circuits by color.

In the present invention, a color-coded cap attached to an access cover marks a particular circuit that is associated with the access cover. For example, a cap may be formed of a red, yellow, brown, or purple material, where each color designates a different type of circuit. Red may be used to mark circuits providing telecommunications service to a fire department, police station, and/or alarm companies; yellow may be used to mark circuits feeding banks; brown may be used to mark circuits feeding hospitals; and purple may be used to mark digital subscriber line (DSL) circuits.

Connector block 24 of FIG. 3 is a general depiction of an electrical connector block 24, and the depiction and description of connector block 24 is not intended to limit the present invention in any way. An apparatus of the present invention may also be used to replace or repair an access cover securing mechanism of other suitable connector blocks, including, but not limited to, both Type A and Type B connector blocks (as described in the Background section). Of course, aspects of the apparatus may change, depending on the structure of the connector block. For example, if the connector block does not have conductor-receiving recesses (e.g., recesses 27A and 27B shown in FIG. 3), locating pins of the apparatus may be removed or locating pins 18 and 20 of the exemplary embodiment of cap 10 may be modified to adapt to the access cover of the particular connector block.

Examples of suitable connector blocks that an inventive apparatus of the present invention may be attached to are described in U.S. patent application Ser. No. 10/941,506, entitled, "INSULATION-DISPLACEMENT SYSTEM FOR TWO ELECTRICAL CONNECTORS", and filed on Sep. 15, 2004, U.S. patent application Ser. No. 10/941,441, entitled, "CONNECTOR ASSEMBLY FOR HOUSING INSULATION DISPLACEMENT ELEMENTS", and filed on Sep. 15, 2004, U.S. Pat. No. 6,406,324, issued on Jun. 18, 2002 and entitled, "INSULATION DISPLACEMENT CONNECTOR TERMINAL BLOCK", and U.S. Pat. No. 6,254,421, issued on Jul. 3, 2001 and entitled, "CONNECTOR ASSEMBLY HAVING PIVOTING WIRE CARRIER WITH POSITION DETENTS".

Although the present invention has been described with reference to preferred embodiments, workers skilled in the art will recognize that changes may be made in form and detail without departing from the spirit and scope of the invention.

The invention claimed is:

1. An apparatus configured to attach to an access cover of an insulation displacement connector block, the access cover being moveable between a first position and a second position, the apparatus comprising:

a body adapted to attach to the access cover; and an appendage extending from the body, wherein at least a portion of the appendage is adapted to engage with the insulation displacement connector block to form at least a part of a securing mechanism for securing the access cover in the first position, wherein the portion of the appendage may be disengaged from the insulation displacement connector block to allow movement of the access cover from the first position to the second position.

2. The apparatus of claim 1, wherein the appendage and the body are a unitary unit.

3. The apparatus of claim 1, and further comprising a gripping tab extending from the body.

4. The apparatus of claim 1, wherein the securing mechanism is a latching mechanism which comprises:

a latching member; and a release member, wherein the appendage of the apparatus forms at least a part of the release member.

5. The apparatus of claim 1, wherein the apparatus is formed of a material selected from a group consisting of polycarbonate, polypropylene, polyester, and polyethylene.

6. The apparatus of claim 1, wherein the apparatus is formed of a material selected from a group consisting of a red material, yellow material, brown material, and purple material.

7. The apparatus of claim 1, and further comprising:

a means for aligning the apparatus with respect to the access cover.

8. The apparatus of claim 7, wherein the means comprises a locating pin extending from the body.

9. The apparatus of claim 8, wherein the locating pin is configured to be received in a recess in the access cover.

10. The apparatus of claim 1, wherein the apparatus is releasably attached to the access cover.

11. The electrical connector assembly of claim 10, wherein the apparatus is formed of a material selected from a group of materials consisting of red, yellow, brown, and purple colors.

12. An electrical connector assembly comprising:

a housing including an insulation displacement connector element, wherein the insulation displacement connector element is adapted to electrically connect with a conductor partially disposed within the housing;

an access cover connected to the housing, the access cover being moveable between a closed position and an open position, wherein in the open position, the insulation displacement connector element disposed within the housing is accessible; and an apparatus releasably attached to the access cover, wherein at least a portion of the apparatus is adapted to engage with the housing to form at least a part of a securing mechanism for securing the access cover in the closed position, wherein the portion of the apparatus may be disengaged from the housing to allow movement of the access cover from the first position to the second position.

13. The electrical connector assembly of claim 12, wherein the securing mechanism for securing the access cover in a closed position is a latching mechanism.

14. The electrical connector assembly of claim 12, wherein the access cover includes a pivot portion and a cover portion, wherein the pivot portion is pivotally mounted to the housing to allow the access cover to pivot between the open position and the closed position, and wherein the apparatus inhibits the access cover from pivoting between the open position and the closed position.

15. The electrical connector assembly of claim 12 wherein the apparatus is formed of a material selected from a group consisting of polycarbonate, polypropylene, polyester, and polyethylene.

16. The electrical connector assembly of claim 12, wherein the apparatus comprises:

a body configured to attached to the access cover; and an appendage extending from the body, wherein at least a portion of the appendage engages with the housing to form at least a part of the securing mechanism.

17. The electrical connector assembly of claim 16, wherein the appendage and the body are a unitary unit.

18. The electrical connector assembly of claim 16, wherein the apparatus further comprises a gripping tab extending from the body.

19. The electrical connector assembly of claim 16, wherein the apparatus further comprises:

a means for aligning the apparatus with respect to the access cover.

20. The electrical connector assembly of claim 19, wherein the means comprises a locating pin extending from the body.

21. The electrical connector assembly of claim 20, wherein the locating pin is configured to be received in a recess in the access cover.

* * * * *

UNITED STATES PATENT AND TRADEMARK OFFICE

CERTIFICATE OF CORRECTION

PATENT NO. : 7,331,814 B2
APPLICATION NO. : 11/170956
DATED : February 19, 2008
INVENTOR(S) : Jerome A. Pratt It is certified that error appears in the above-identified patent and that said Letters Patent is hereby corrected as shown below:

Column 10,
Line 9, delete "attached" and insert -- attach -- therefor.

Signed and Sealed this

Fifteenth Day of July, 2008

JON W. DUDAS
*Director of the United States Patent and Trademark Office*